US008056265B2

(12) United States Patent
Pirkle et al.

(10) Patent No.: US 8,056,265 B2
(45) Date of Patent: Nov. 15, 2011

(54) SHOE TYING AID AND METHOD

(75) Inventors: Fred L. Pirkle, Abington, PA (US); Timothy L. Owens, Mechanicsville, PA (US)

(73) Assignee: Therm-Omega-Tech, Inc., Warminster, PA (US)

( * ) Notice: Subject to any disclaimer, the term of this patent is extended or adjusted under 35 U.S.C. 154(b) by 427 days.

(21) Appl. No.: 12/429,456

(22) Filed: Apr. 24, 2009

(65) Prior Publication Data

US 2010/0269373 A1 Oct. 28, 2010

(51) Int. Cl.
*A43C 11/00* (2006.01)

(52) U.S. Cl. ..... 36/50.1; 36/50.5; 24/712.1

(58) Field of Classification Search ..... 36/50.1, 36/50.5, 51, 52, 54; 24/130, 712.9, 712.1, 24/712.5, 712.2, 713, 713.6
See application file for complete search history.

(56) References Cited

U.S. PATENT DOCUMENTS 468,819 A * 2/1892 McAnarney ..... 24/129 R
1,020,963 A * 3/1912 Cake ..... 24/18
1,231,309 A * 6/1917 Stout ..... 24/130
4,485,529 A * 12/1984 Blum ..... 24/712.2
4,553,293 A * 11/1985 Blum ..... 24/712.2
4,790,048 A * 12/1988 Arnt ..... 24/712.1
4,879,787 A * 11/1989 Walls ..... 24/712.2
4,949,437 A * 8/1990 Anderson ..... 24/712.2
5,119,539 A * 6/1992 Curry ..... 24/712.1
5,402,589 A * 4/1995 Lubrani et al. ..... 36/50.1
5,979,028 A * 11/1999 Hicks et al. ..... 24/712.9
6,938,308 B2 * 9/2005 Funk ..... 24/712.9
6,952,890 B1 * 10/2005 Blakeslee ..... 36/50.1
2003/0041478 A1 * 3/2003 Liu ..... 36/50.1
2004/0172850 A1 * 9/2004 King, Jr. ..... 36/50.1
2005/0166426 A1 * 8/2005 Donnadieu et al. ..... 36/50.5
2006/0053658 A1 * 3/2006 Voughlohn ..... 36/50.1
2006/0168850 A1 * 8/2006 Wartel et al. ..... 36/136
2006/0174516 A1 * 8/2006 Peruzzo ..... 36/50.5
2007/0137003 A1 6/2007 Zebe, Jr.
2008/0083134 A1 * 4/2008 Lin ..... 36/50.1
2011/0035961 A1 * 2/2011 Volin ..... 36/54

* cited by examiner

*Primary Examiner* — Darnell Jayne
*Assistant Examiner* — Devin Barnett
(74) *Attorney, Agent, or Firm* — Howson & Howson LLP

(57) ABSTRACT

A shoe can be tied using only one hand if provided with a tying aid in the form of a generally T-shaped unit comprising a leg having two laterally extending ears. The leg is secured between rows of eyelets on the opposed flaps of the shoe by one or more of the lengths of lace extending across the gap between the flaps. The lengths of shoelace that would otherwise be tied in a bow are instead wrapped around the ears of the tying aid in alternating fashion, preferably twice around each ear, in a manner similar to the manner in which a mooring line is secured to the cleat of a boat.

12 Claims, 4 Drawing Sheets

SHOE TYING AID AND METHOD

FIELD OF THE INVENTION

This invention relates to footwear, and more particularly to a device for assisting an individual in tying a shoe and a method for tying a shoe.

BACKGROUND OF THE INVENTION

A conventional shoe utilizing a shoelace, has rows of eyelets on opposed flaps overlying a tongue. The shoelace is threaded back and forth from one row of eyelets to the other. When the end portions of the shoelace, protruding through the endmost eyelets remote from the toe of the shoe, are pulled, the flaps are drawn toward each other by tension in the portions of the shoelace bridging the gap between the flaps. The end portions are then tied, typically by forming an overhand knot and a bow. Usually the bow is one that can be released simply by pulling on one of the ends of the shoelace. A more secure bow can be formed by forming two loops in the sections of lace extending from the overhand knot and tying the two loops in another overhand knot. Various other shoelace tying techniques are known.

With the exception of some very skilled magicians most people need two hands to tie a satisfactory shoelace knot. This means that individuals who have lost the use of one hand through injury, because of a stroke, or as a result of some other cause, cannot tie shoes by themselves. Young children also lack the manual dexterity to tie their own shoes, even with two hands.

SUMMARY OF THE INVENTION

This invention affords a simple and effective way for an individual to tie a shoe with only one hand, and also makes it possible for a child who has not yet learned to tie one of the conventional bows referred to above to tie his or her shoes easily.

Briefly, the invention resides in the use of a tying aid in the form of a generally T-shaped unit comprising a leg having two laterally extending ears. The leg is secured between the two rows of eyelets on the opposed flaps of the shoe by one or more of the lengths of lace extending across the gap between the flaps. The lengths of shoelace that would otherwise be tied in a bow are instead wrapped around the ears of the tying aid in alternating fashion, preferably twice around each ear, in a manner similar to the manner in which a mooring line is secured to the cleat of a boat.

In accordance with a first aspect of the invention, an article of footwear comprises a pair of opposed flaps, each flap having an upper end and a lower end, the lower end being closer than the upper end to a toe portion of the article of footwear. Each flap also has a row of eyelets. The rows of eyelets extending in substantially parallel, opposed, relationship to each other in a direction extending from the lower ends of the flaps to the upper ends of the flaps. A lace is threaded through the eyelets and has plural portions, each extending from an eyelet on one of the flaps to an eyelet on another of the flaps. The lace has two end portions extending respectively from an eyelet in each row. The plural portions extending from one flap to the other exert tension on the flaps, thereby urging said flaps toward each other. A substantially rigid tying aid comprises a leg extending substantially parallel to and between the rows of eyelets, and a pair of ears, joined with, and extending laterally in opposite directions from, the leg at a location adjacent the eyelets from which the two end portions extend. The leg is engaged with, and held in place between, the rows of eyelets by at least one of the plural portions of the lace extending from one flap to the other. Each of said ears of the tying aid has a narrow inner part by which it is connected to the leg, and an enlarged outer part remote from the leg. Parts of the two end portions of the lace are disposed in parallel relation to each other and wrapped alternately about the narrow inner part of each ear, so that the lace is retained by the ears and the tension exerted on the flaps is maintained.

Preferably a slot is formed between each of the ears and the leg, and each slot extends from a junction of the narrow inner part of an ear with the leg to an open end constituted by a gap between the enlarged outer part of an ear and the leg. Each gap is narrower than the adjacent part of the slot at the open end of which it is located. The end portions of the lace extend through the part of each slot adjacent the gap thereof, and each gap is sufficiently narrow to resist passage of the end portions of the lace outward through the gap from the adjacent part of the slot.

The width of each gap is preferably less than the width of a part of each lace end portion extending through the adjacent part of the slot at the open end of which the gap is located.

The gap may be formed by a protrusion on an ear extending toward the leg.

In a preferred embodiment, the leg has a first portion extending from a location at which it meets the narrow parts of said ears toward an end of the leg remote from the ears, and this first portion of the leg has side edges that diverge with respect to each other from said location. Each slot is formed by one of the ears and an adjacent one of the edges of the first portion of the leg.

The leg can be formed with at least one through hole, and at least one of the plural portions of the lace that extend from one flap to the other is threaded through the through hole, so that the leg is engaged with, and held in place between, the rows of eyelets. Preferably the leg is formed with at least two such through holes, and at least one of the plural portions of the lace that extend from one flap to the other is threaded through each of the through holes.

The enlarged outer part of each ear can be advantageously formed with a spacer protruding therefrom and in engagement with an adjacent one of the flaps of the article of footwear. The spacer cause a gap to be formed between the inner part of each ear and an adjacent flap for receiving parts of the lace wound about the inner part of each ear. Preferably the parts of the two end portions of the lace disposed in parallel relation to each other are wrapped twice around the narrow inner part of each ear.

Another aspect of the invention is the tying aid itself. The tying aid comprises a unitary, substantially rigid, element having a leg extending in a first direction, and a pair of ears, joined with, and extending laterally in opposite directions from, the leg. Each ear has a narrow inner part by which it is connected to the leg, and an enlarged outer part remote from the leg. A slot is formed between each ear and the leg, the slot extending from a location at which the ear joins the leg to an end opening, which is narrower than a portion of the slot adjacent the end opening.

Still another aspect of the invention is a method of tying the lace of an article of footwear having a pair of opposed flaps, each flap having an upper end and a lower end, the lower end being closer than the upper end to a toe portion of the article of footwear, and each flap also having row of eyelets, the rows of eyelets extending in substantially parallel, opposed, relationship to each other in a direction extending from the lower ends of the flaps to the upper ends of the flaps, and a lace threaded through the eyelets and having plural portions, each extending from an eyelet on one of the flaps to an eyelet on the other flap, the lace having two end portions extending respectively from an eyelet in each row. In the article of footwear the plural portions of the lace, extending from one flap to the other, exert tension on the flaps, thereby urging the flaps toward each other. The method comprises installing in the article of footwear a substantially rigid tying aid comprising a leg and a pair of ears joined with, and extending laterally in opposite directions from, the leg, each of the ears having a narrow inner part by which it is connected to said leg, and an enlarged outer part remote from the leg. Installation is carried out by positioning the leg so that it extends substantially parallel to and between the rows of eyelets, and so that the junction of the ears with the leg is located adjacent the eyelets from which the two end portions extend, and causing the tying aid to be held in place between the rows of eyelets by at least one of the plural portions of the lace. The two end portions of the lace are then wrapped, in parallel relation to each other, alternately about the narrow inner part of each ear, so that the lace is retained by the ears, and the tension exerted on the flaps by the plural portions of the lace is maintained.

Further details and advantages of the invention will be apparent from the following description when read in conjunction with the drawings.

BRIEF DESCRIPTION OF THE DRAWINGS

FIGS. 8(*b*)-8(*i*) are top plan views showing successive steps in the tying process.

DETAILED DESCRIPTION OF THE PREFERRED EMBODIMENTS

Figure 4:
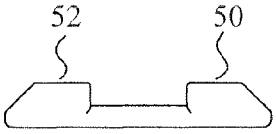
FIG. 4 is a top plan view.
Figure 5:
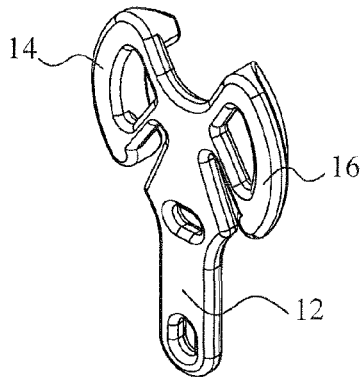
FIG. 5 is an oblique perspective view of the front side.

As mentioned above, the invention is practiced by the use of a tying aid. The tying aid 10, shown in FIGS. 1-6 is preferably a unitary, substantially rigid, element molded from a suitable low friction polymer such as recycled ABS (acrylonitrile butadiene styrene) or recycled polycarbonate. It comprises a leg 12 having ears 14 and 16 protruding laterally from one of its ends. The ears have narrow inner parts 18 and 20 connected to the leg, and larger outer parts 22 and 24. For weight reduction, the ears can be formed with openings 26 and 28.

The leg is formed with a tapered portion 30 which extends from a location at which it meets the narrow parts 18 and 20 of said ears toward the end of the leg remote from the ears. The side edges 32 and 34 of portion 30 of the leg diverge with respect to each other from the location at which it meets the narrow parts of the ears. An oblique slot 36 is formed between side edge 32 and ear 14, and a similar oblique slot 38 is formed between side edge 34 and ear 16.

The openings 40 and 42 of the slots are made narrower than the adjacent inner parts of the slots by protrusion 44 on ear 14 and protrusion 45 on ear 16. Preferably the width of each of these openings is about 2 mm, slightly less than the diameter of a typical shoelace, but the openings should not be so narrow that a shoelace cannot be made to pass through the opening by the manual application of a force sufficient to deform the shoelace.

Figure 2:
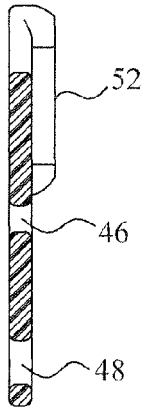
FIG. 2 is a cross-sectional view taken on plane 2-2 in FIG. 1.

The leg is provided with a first through hole 46, and a second hole 48 space longitudinally from hole 46. Each of these holes should be large enough that two portions of shoelace can be threaded through it, and rounded as shown in FIG. 2 to reduce friction.

As shown in FIGS. 2, 3, 4 and 6, the rear sides of the ears are formed with arc-shaped protrusions 50 and 52, which are positioned to bear against the flaps of a shoe or other article of footwear, and thereby space the central portion of the tying aid between the ears from the flaps. The spacing of the portion of the tying aid from the flaps of the article of footwear provides room for portions of the laces wound around the ears so that they do not exert excessive, localized, pressure against the wearer's foot. The arc-shaped protrusions 50 and 52 have a relatively large sufficient surface area for contacting the flaps of the article of footwear so that they do not exert excessive pressure.

Figure 6:
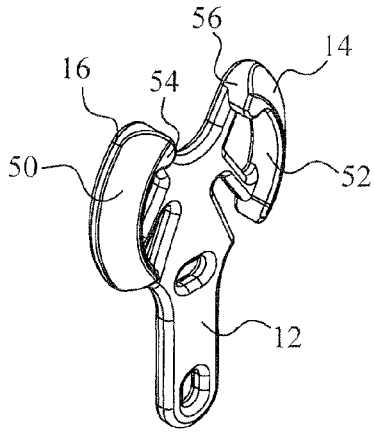
FIG. 6 is an oblique perspective view of the rear side.
Figure 1:
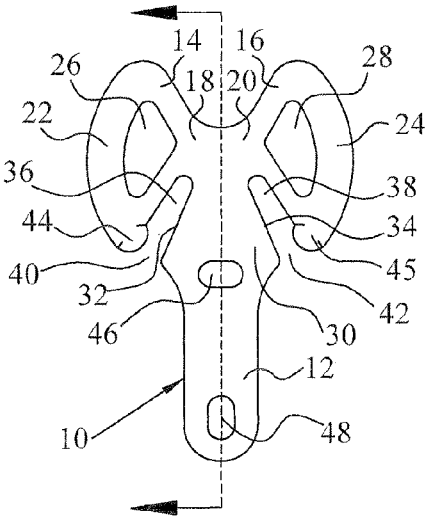
FIG. 1 is a front elevational view of a shoe tying aid in accordance with the invention.
Figure 3:
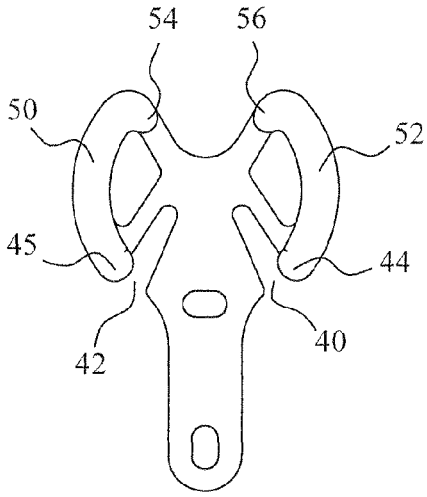
FIG. 3 is a rear elevational view of the shoe tying aid.

Protrusions 44 and 45, which reduce the widths of the openings of the slots are extensions of protrusions 52 and 50 respectively. The protrusions 50 and 52 also have overhanging parts 54 and 56 at their opposite ends, as seen in FIGS. 3 and 6. These overhanging parts facilitate wrapping of the shoelaces around the upper part of the tying aid.

Figure 7:
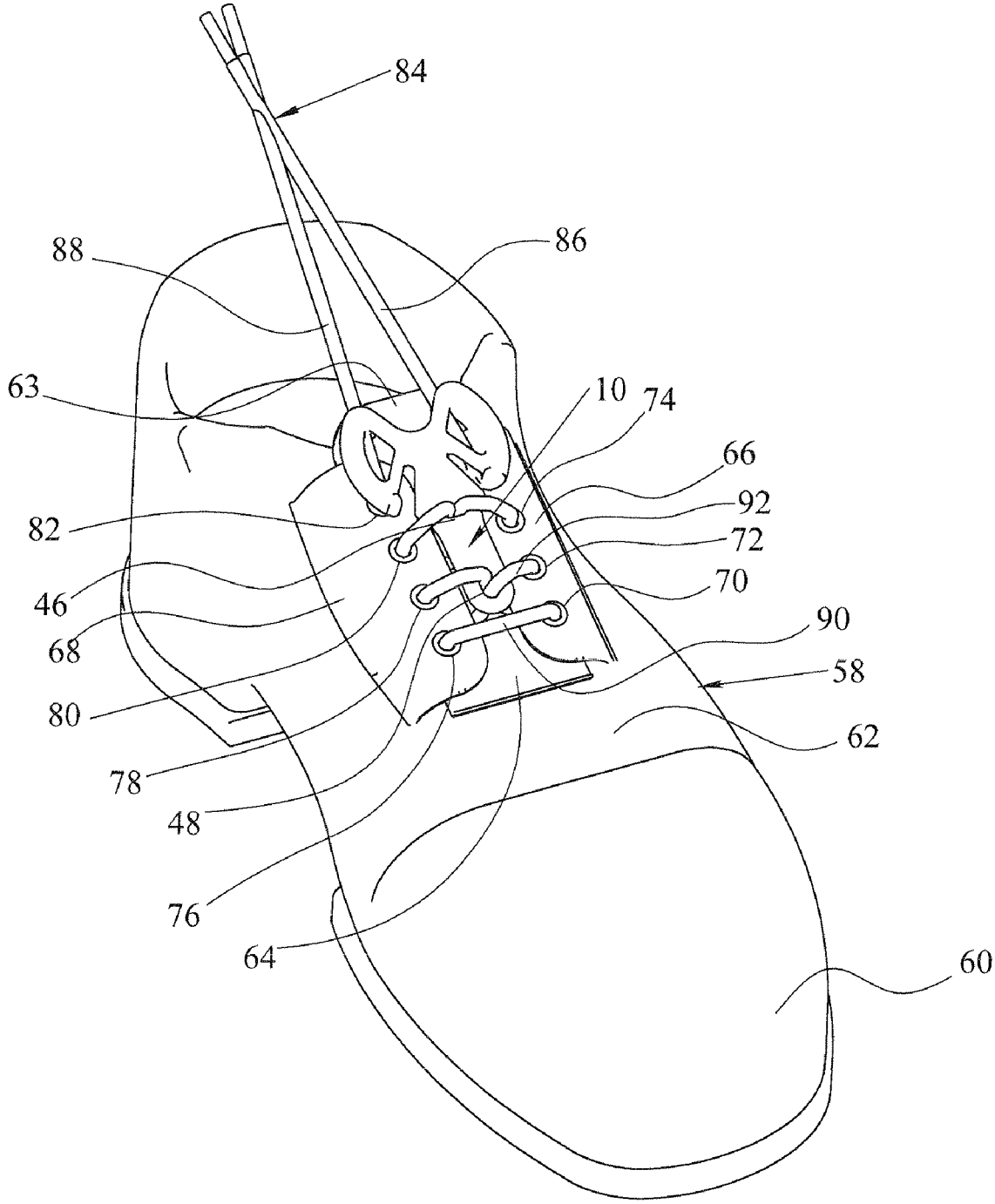
FIG. 7 is an enlarged perspective view of a shoe in which the shoe tying aid has been installed, illustrating a first step in the tying process.
Figure 8A:
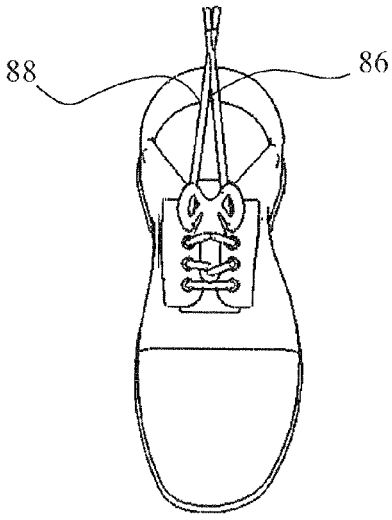
FIG. 8(*a*) is a top plan view of the shoe as shown in FIG. 7.
Figure 8B:
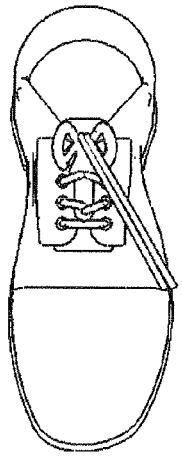
Figure 8C:
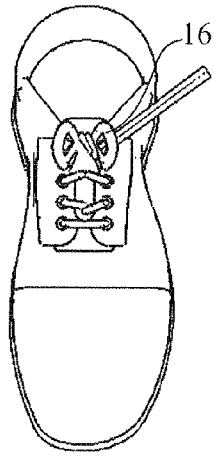
Figure 8D:
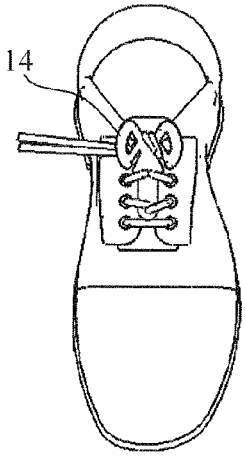
Figure 8E:
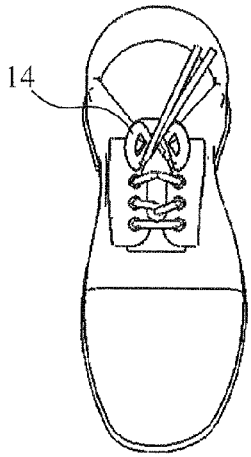
Figure 8F:
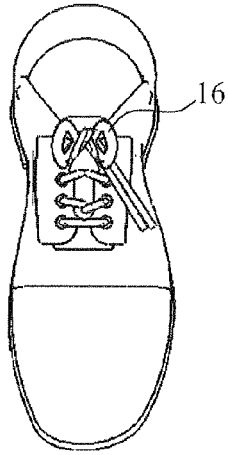
Figure 8G:
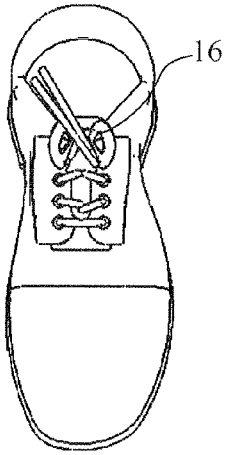
Figure 8H:
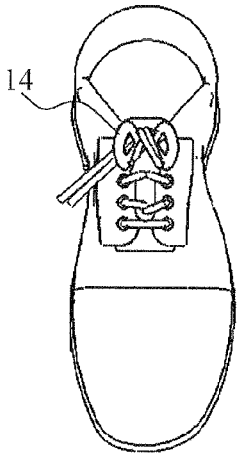
Figure 8I:
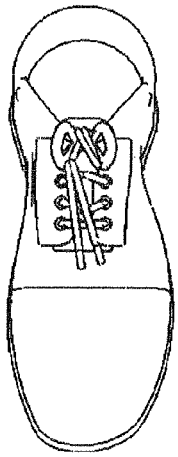

The manner in which the tying aid is installed in an article of footwear is illustrated in FIG. 7, which shows a shoe 58 having a toe 60, an instep 62, a tongue 63 extending upward and rearward from the instep, and a pair of flaps 66 and 68 in opposed, spaced, relationship to each other and partly overlying the tongue 64.

Flap 66 has a row of eyelets 70, 72, 74, and a fourth eyelet (not seen in FIG. 7). Flap 68 has a similar row of eyelets 76, 78, 80 and 82, parallel to the row of eyelets in flap 66. Each eyelet in flap 68 is directly opposite a corresponding eyelet in flap 66.

A shoelace 84 is threaded through the eyelets alternately from one flap to the other so that a pulling force exerted on the end portions 86 and 88 of the lace will place the portions of the lace that extend from one flap to the other in tension, thereby tensioning the flaps and tightening the shoe on the wearer's foot. As shown in FIG. 7, a bottom portion 90 of the lace extends from one flap to the other on the top side of the flaps and downward through eyelets 70 and 76. A second portion 92 of the lace extends from eyelet 76, underneath flap 68, upward through the gap between the flaps, and across the top side of flap 66 and into eyelet 72. A third portion 94 similarly extends from eyelet 70, underneath flap 66, upward through the gap between the flaps, and across the top side of flap 68, into eyelet 78. As seen in FIG. 7, both portions 92 and 94 of the lace extend through the hole 48 in the leg of the tying aid 10. Further portions of the lace (not shown) cross over underneath the flaps and the lace emerges through eyelets 74 and 80, from which portions extend downward through hole 46 in the tying aid, crossing over to eyelet 82 and its opposite counterpart, from which the end portions 88 and 86 of the lace emerge.

A shoe, of course, can be laced in any of several patterns. Regardless of which lacing pattern is adopted the lacing preferably passes though at least one of holes 46 and 48 in the tying aid in order to hold the tying aid in place when the shoe not being worn. It is possible, however, to slip the leg of the tying aid underneath lace elements that extend across the gap between the flaps without threading the lace through one or both holes in the leg 12.

The steps of wrapping the lace portions 86 and 99 around the ears of the tying aid are shown in sequence in FIGS. 8(*a*)-8(*i*). FIG. 8(*a*) corresponds to FIG. 7, and shows the lace end portions 86 and 88 in their initial position. The user can tighten the flaps of the shoe to the desired degree by grasping and pulling on the lace end portions with one hand. Then, using that same hand, the user can bend the lace ends forward through the gap between the upper parts of the ears as in FIG. 8(*b*), wrapping them around ear 16 and pulling the lace into the slot 38 (FIG. 1) between ear 16 and leg 12 by overcoming the resistance imposed by the narrowed opening of the slot, thereby reaching the configuration shown in FIG. 8(*c*).

The end portions of the lace are than moved behind the ears to the opposite side, as shown in FIG. 8(*d*), and pulled into slot 36 (FIG. 1) so that they are wrapped in a first direction around ear 14 and extend upward over the top of the tying aid, as shown in FIG. 8(*e*).

The end portions are then wrapped around ear 16 once again as illustrated in FIGS. 8(*f*) and 8(*g*), this time in the direction opposite to the direction in which they were wrapped around ear 16 previously. In FIG. 8(*g*), the end portions of the lace are shown pulled into slot 38 (FIG. 1) and extending upward toward the opposite side of the shoe. Then, as shown in FIGS. 8(*h*) and 8(*i*), the end portions of the lace are wrapped a second time around ear 14 in the same direction in which they were previously wrapped around ear 14, and pulled into the slot 36, by exerting sufficient tension to overcome the resistance to entry imposed by the narrow opening of the slot. The shoe is then securely tied and in the condition shown in FIGS. 8(*i*) and 9.

Figure 9:
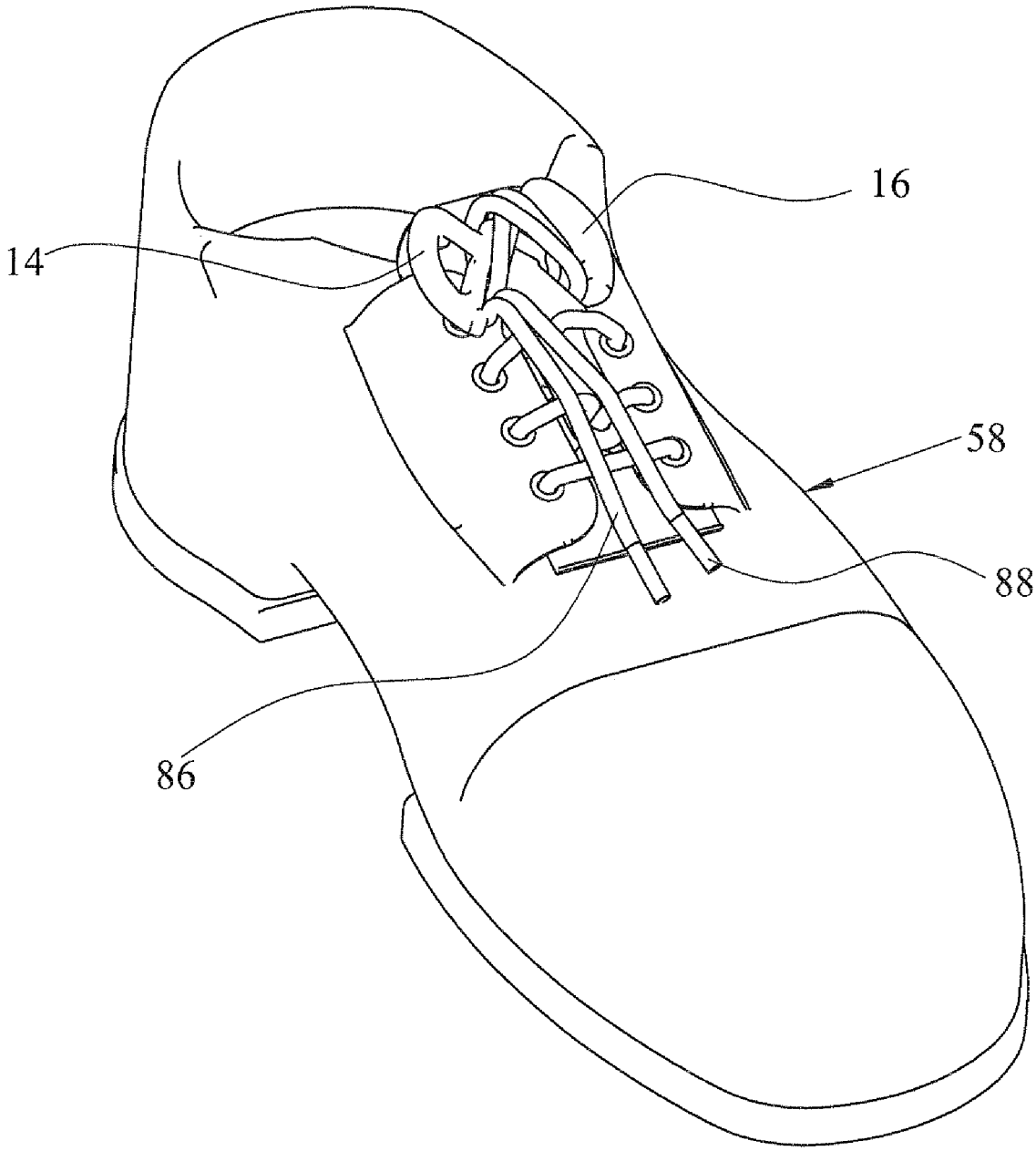
FIG. 9 is an enlarged perspective view of the completely tied shoe, corresponding to FIG. 8(*i*).

As seen in FIG. 9, the lace is wrapped twice around each of ears 14 and 16 and held in the slot between ear 14 and the leg of the tying aid by the protrusion that narrows the opening of the slot. Each slot should be sufficient in size to accommodate four sections of lace, preferably with a relatively tight fit so the lace will not slide through the slots.

As will be apparent, the shoe can be tied using one hand, in a motion that is easily learned and easily carried out. Untying the shoe is simply a matter of grasping the end portions of the lace as seen in FIG. 9, pulling them out of slot 36, and reversing the steps shown in FIGS. 8(*a*)-8(*h*).

Although the tying procedure shown in FIG. 8(*a*)-8(*i*) is preferred, other tying techniques can be utilized. For example, if the slots in the tying aid are designed to hold two sections of lace with a relatively tight fit, the lace can be wrapped only once around each ear as in FIG. 8(*e*). Here, where the lace is wrapped only once around each ear, the tightness of the fit of the lace in the slots is more important.

Other tying aid configurations can also be adopted. For example, one skilled in the art will be able to vary the shapes and sizes of the ears, the leg, and the holes in the leg, and make various other changes while still retaining many or all of the advantages of the invention, the scope of which is defined by the appended claims.

What is claimed is:

1. An article of footwear comprising:

a pair of opposed flaps, each flap having an upper end and a lower end, the lower end being closer than the upper end to a toe portion of the article of footwear, and each flap also having a row of eyelets, the rows of eyelets extending in substantially parallel, opposed, relationship to each other in a direction extending from the lower ends of the flaps to the upper ends of the flaps;

a lace threaded through said eyelets and having plural portions, each extending from an eyelet on one of said flaps to an eyelet on another of said flaps, said lace having two end portions extending respectively from an eyelet in each row, said plural portions exerting tension on said flaps, thereby urging said flaps toward each other; and a substantially rigid tying aid for tying a shoe with one hand comprising a leg extending substantially parallel to and between said rows of eyelets, and a pair of ears, joined with, and extending laterally in opposite directions from, said leg at a location adjacent the eyelets from which said two end portions extend, the leg being engaged with, and held in place between, said rows of eyelets by at least one of said plural portions of the lace;

in which each of said ears of the tying aid has a narrow inner part by which it is connected to said leg, and an enlarged outer part remote from said leg; and in which parts of said two end portions of the lace are disposed in parallel, side-by-side relation to each other, and said parallel, side-by-side, parts extend around the narrow part of one ear, from said one ear to the other ear, and around the narrow part of said other ear;

whereby the lace is retained by said ears and the tension exerted on the flaps by said plural portions of the lace is maintained.

2. An article of footwear according to claim 1, having a slot formed between at least one of the ears and the leg, in which said slot extends from a junction of the narrow inner part of an ear with the leg to an open end constituted by a gap between the enlarged outer part of an ear and the leg, in which each said gap is narrower than the adjacent part of said slot, in which said end portions of the lace extend through the part of said slot adjacent the gap thereof, and each said gap is sufficiently narrow to resist passage of said end portions of the lace outward through the gap from the adjacent part of the slot.

3. An article of footwear according to claim 1, having a slot formed between each of the ears and the leg, in which each slot extends from a junction of the narrow inner part of an ear with the leg to an open end constituted by a gap between the enlarged outer part of an ear and the leg, in which each said gap is narrower than the adjacent part of the slot at the open end of which it is located, in which said end portions of the lace extend through the part of each said slot adjacent the gap thereof, and each said gap is sufficiently narrow to resist passage of said end portions of the lace outward through the gap from the adjacent part of the slot.

4. An article of footwear according to claim 1, having a slot formed between each of the ears and the leg, in which each slot extends from a junction of the narrow inner part of an ear with the leg to an open end constituted by a gap between the enlarged outer part of an ear and the leg, in which said end portions of the lace extend through each said gap, and in which each said gap is narrower than the adjacent part of the slot at the open end of which it is located, and the width of each said gap is less than the width of a part of each lace end portion extending through the adjacent part of the slot at the open end of which it is located.

5. An article of footwear according to claim 1, having a slot formed between each of the ears and the leg, in which each slot extends from a junction of the narrow inner part of an ear with the leg to an open end constituted by a gap between the enlarged outer part of an ear and the leg, in which said end portions of the lace extend through each said gap, and in which each said gap is formed by a protrusion on an ear extending toward the leg, and each said gap is narrower than the adjacent part of the slot at the open end of which it is located.

6. An article of footwear according to claim 1, having a slot formed between each of the ears and the leg, in which each slot extends from a junction of the narrow inner part of an ear with the leg to an open end constituted by a gap between the enlarged outer part of an ear and the leg, in which said end portions of the lace extend through each said gap, in which each said gap is formed by a protrusion on an ear extending toward the leg, and each said gap is narrower than the adjacent part of the slot at the open end of which it is located, and in which each said gap is sufficiently narrow to resist passage of said end portions of the lace outward through the gap from the adjacent part of the slot.

7. An article of footwear according to claim 1, having a slot formed between each of the ears and the leg, in which each slot extends from a junction of the narrow inner part of an ear with the leg to an open end constituted by a gap between the enlarged outer part of an ear and the leg, in which said end portions of the lace extend through each said gap, in which each said gap is formed by a protrusion on an ear extending toward the leg, and each said gap is narrower than the adjacent part of the slot at the open end of which it is located, and in which the width of each said gap is less than the width of a part of each lace end portion extending through the adjacent part of the slot at the open end of which it is located.

8. An article of footwear according to claim 1, in which the leg is elongated, in which the leg has a first portion extending from a location at which it meets the narrow parts of said ears toward an end of the leg remote from said ears, in which said first portion of the leg has side edges that diverge with respect to each other from said location, and having a pair of slots, each slot being formed by one of said ears and an adjacent one of said edges of the first portion of the leg.

9. An article of footwear according to claim 1, in which said leg is formed with at least one through hole, and in which at least one of said plural portions of the lace is threaded through said through hole, whereby the leg is engaged with, and held in place between, said rows of eyelets.

10. An article of footwear according to claim 1, in which said leg is formed with at least two through holes, and in which at least one of said plural portions of the lace is threaded through each said through hole, whereby the leg is engaged with, and held in place between, said rows of eyelets.

11. An article of footwear according to claim 1, in which the enlarged outer part of each ear is formed with a spacer protruding therefrom and in engagement with an adjacent one of said flaps, whereby a gap is formed between the inner part of each ear and an adjacent flap for receiving parts of the lace wound about said inner part of each ear.

12. An article of footwear according to claim 1, in which said parts of said two end portions of the lace disposed in parallel relation to each other are wrapped twice around the narrow inner part of each ear.

* * * * *